US010680386B2

(12) United States Patent
Kakino et al.

(10) Patent No.: US 10,680,386 B2
(45) Date of Patent: Jun. 9, 2020

(54) CONNECTOR AND ELECTRONIC DEVICE

(71) Applicant: KYOCERA CORPORATION, Kyoto (JP)

(72) Inventors: Masayoshi Kakino, Yokohama (JP); Masashi Kakeno, Yokohama (JP); Shunsuke Morita, Yokohama (JP)

(73) Assignee: KYOCERA CORPORATION, Kyoto (JP)

( * ) Notice: Subject to any disclaimer, the term of this patent is extended or adjusted under 35 U.S.C. 154(b) by 0 days.

(21) Appl. No.: 16/359,903

(22) Filed: Mar. 20, 2019

(65) Prior Publication Data

US 2019/0296492 A1 Sep. 26, 2019

(30) Foreign Application Priority Data

Mar. 23, 2018 (JP) ..... 2018-056715

(51) Int. Cl.

| | |
|---|---|
| ***H01R 13/64*** | (2006.01) |
| ***H01R 13/6474*** | (2011.01) |
| ***H01R 13/502*** | (2006.01) |
| ***H01R 13/26*** | (2006.01) |
| ***H01R 12/71*** | (2011.01) |

(52) U.S. Cl.

CPC ..... *H01R 13/6474* (2013.01); *H01R 12/716* (2013.01); *H01R 13/26* (2013.01); *H01R 13/502* (2013.01)

(58) Field of Classification Search

CPC .. H01R 13/6474; H01R 13/502; H01R 13/26; H01R 12/716

USPC ..... 439/74, 247, 248, 246

See application file for complete search history.

(56) References Cited

U.S. PATENT DOCUMENTS

| | | | | |
|---|---|---|---|---|
| 2014/0206218 | A1* | 7/2014 | Liu | H01R 12/73 439/247 |
| 2016/0164233 | A1* | 6/2016 | Zhu | H01R 24/542 439/248 |
| 2016/0380374 | A1* | 12/2016 | Singhammer | H01R 4/48 439/247 |
| 2019/0103709 | A1* | 4/2019 | Xu | H01R 13/6474 |
| 2019/0148884 | A1* | 5/2019 | Sugiki | H01R 13/6315 439/247 |
| 2019/0296492 | A1* | 9/2019 | Kakino | H01R 13/502 |

FOREIGN PATENT DOCUMENTS

JP 2014165084 A 9/2014

* cited by examiner

*Primary Examiner* — Abdullah A Riyami
*Assistant Examiner* — Nelson R. Burgos-Guntin
(74) *Attorney, Agent, or Firm* — Duane Morris LLP

(57) ABSTRACT

A connector having a floating structure and a reduced profile that improves transmission characteristics of a signal transmission is provided. A connector according to the present disclosure is to be fitted to a connection object and includes a first insulator, a second insulator that is movable relative to the first insulator, a contact attached to the first insulator and the second insulator, and adjustment members having electrical conductivity arranged within the first insulator. The adjustment members include adjustment portions, which are configured to oppose the contact.

10 Claims, 13 Drawing Sheets

CONNECTOR AND ELECTRONIC DEVICE

CROSS REFERENCE TO RELATED APPLICATION

This application claims priority to and the benefit of Japanese Patent Application No. 2018-056715 (filed on Mar. 23, 2018), the entire contents of which are incorporated herein by reference.

TECHNICAL FIELD

The present disclosure relates to a connector and an electronic device.

BACKGROUND

As a technique for improving reliable connectivity to a connection object, for example, a connector having a floating structure in which a deviation between circuit boards is accommodated by movement of a portion of the connector during and after fitting is known.

According to a known receptacle connector, the contact of the connector has an elaborate shape. Thus, according to this receptacle connector, a floating structure can be maintained and the connector can be miniaturized while satisfying electrical characteristic specifications including characteristic impedance and crosstalk.

SUMMARY

A connector according to embodiments of the present disclosure is a connector to be fitted to a connection object. The connector includes a first insulator, a second insulator movable relative to the first insulator, a contact attached to each of the first insulator and the second insulator, and an adjustment member having electrical conductivity arranged within the first insulator. The adjustment member includes an adjustment portion configured to oppose the contact.

DETAILED DESCRIPTION

Figure 1:
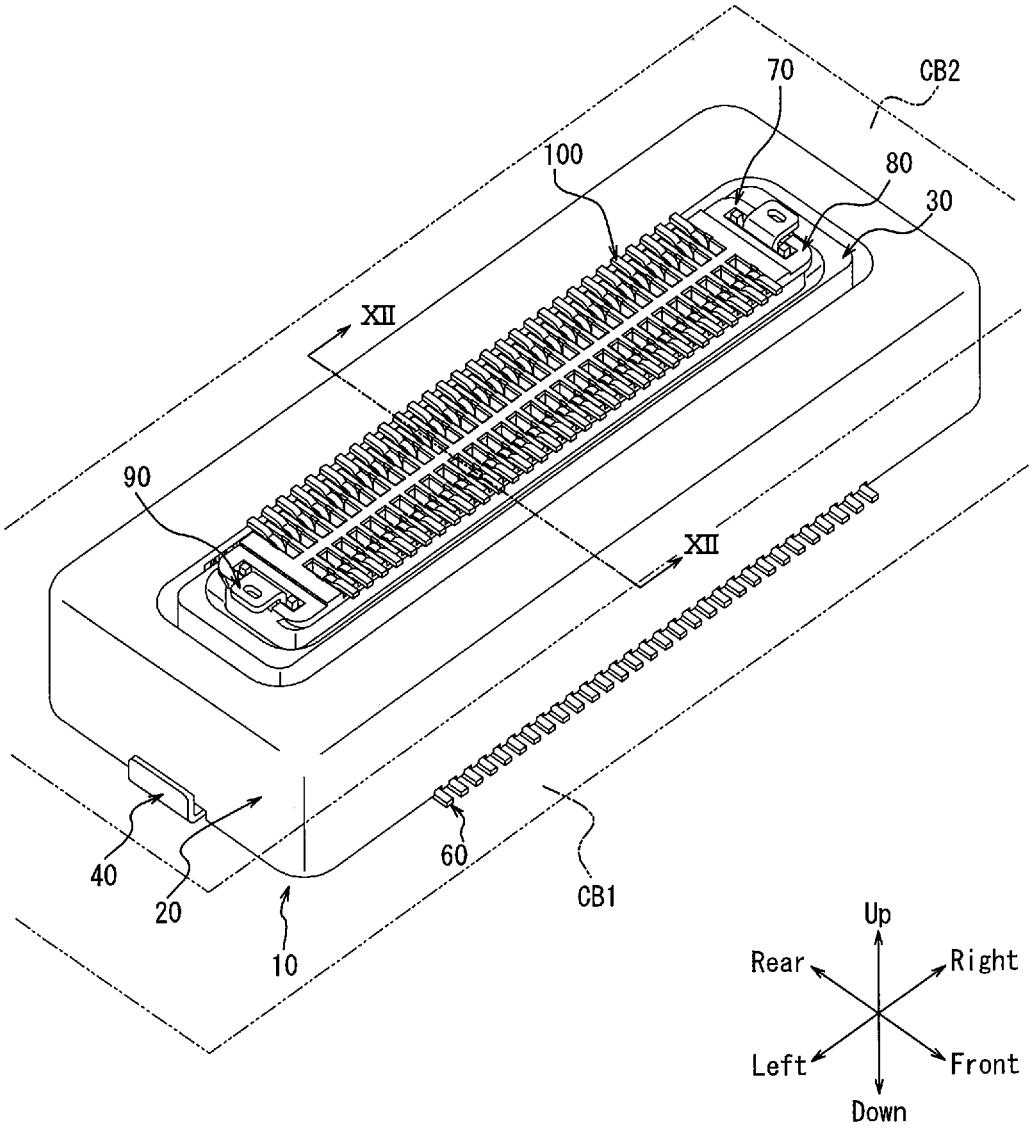
FIG. 1 is an external top perspective view illustrating a state in which a connector according to an embodiment and a contact object are coupled together.

In recent years, miniaturization of electronic devices has progressed at a remarkable rate. In response to this, there is a demand for further miniaturization of connectors which utilize a floating structure mounted on a circuit board in an electronic device. In particular, in order to further miniaturize electronic devices, the distance between substrates coupled together in the electronic device needs to be reduced. This necessitates a reduction in the profile of connectors which utilize a floating structure to couple the substrates together.

Further, information amounts and communication speeds of electronic devices are increasing. Connectors utilizing floating structures need to be designed to support such a large capacity and a high-speed transmission.

A further reduction in the profile of the connector makes it difficult to elaborate the shape of the contact for improvement in the transmission characteristics. The known receptacle connector includes the contact in the elaborate shape in order to conform to the transmission standard. This makes difficult to simultaneously realize a further reduction in the profile and support large capacity and high-speed transmission. Thus, a different design is required to enable the connector to support a large capacity in the case where its profile is further reduced.

A connector according to an embodiment of the present disclosure has a floating structure and improved transmission characteristics for signal transmission when configured with a reduced profile.

Hereinafter, an embodiment of the present disclosure will be described with reference to the accompanying drawings. Terms such as "front-rear direction", "left-right direction", and "up-down direction" used herein correspond to the directions indicated by arrows in the drawings. The directions indicated by the arrows in FIG. 1 to FIG. 9, FIG. 12 and FIG. 13 correspond with each other. Similarly, the directions indicated by the arrows in FIG. 10 and FIG. 11 correspond with each other. In some figures, circuit boards CB1 and CB2 are omitted for the purpose of simplification.

Figure 2:
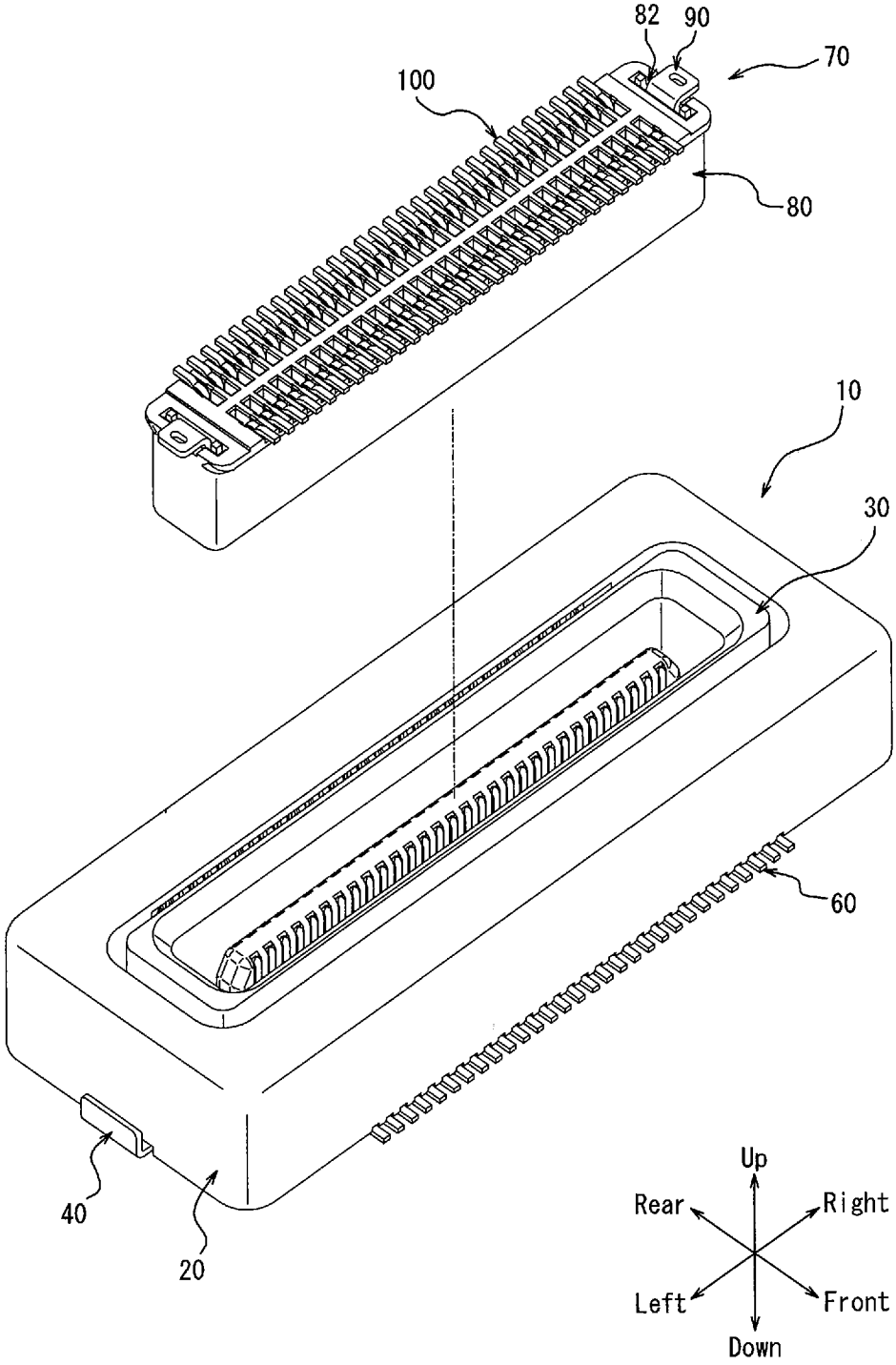
FIG. 2 is an external top perspective view illustrating a state in which the connector according to the embodiment and the contact object are separated from each other.

FIG. 1 is an external top perspective view illustrating a state in which a connector 10 according to an embodiment and a connection object 70 are coupled together. FIG. 2 is an external top perspective view illustrating a state in which the connector 10 according to the present embodiment and the connection object 70 are separated from each other.

In the following description, the connector 10 according to the present embodiment is described as a plug connector, and the connection object 70 is described as a receptacle connector. In particular, when the connector 10 and the connection object 70 are to be coupled, the connector 10 is a plug connector in which contacts 60 do not elastically deform, and the connection object 70 is a receptacle connector in which contacts 100 elastically deform. Further variants of the connector 10 and the connection object 70 are not limited to this configuration. The connector 10 and the connection object 70 may function as the receptacle connector and the plug connector, respectively.

In the following description, it is assumed that the connector 10 and the connection object 70 are mounted on a circuit board CB1 and a circuit board CB2, respectively, and connected to the circuit boards in a direction perpendicular thereto, by way of example. In particular, the connector 10 and the connection object 70 are coupled together along, for example, the up-down direction. The manner by which the connector 10 and the connection object 70 are connected is not limited thereto. The connector 10 and the connection object 70 may be connected parallel to the circuit board CB1 and the circuit board CB2, respectively. Alternatively, one of the connector 10 and the connection object 70 may be connected perpendicular to the corresponding circuit board while the other is connected in parallel to the corresponding circuit board.

The circuit boards CB1 and CB2 may be rigid boards or any other circuit boards. For example, the circuit board CB1 or the circuit board CB2 may be a flexible printed circuit board (FPC).

In the following description, a "fitting direction" includes, for example, the up-down direction. A "direction substantially orthogonal to the fitting direction" includes, for example, the front-rear direction and a direction close thereto. A "fitting side" includes, for example, an upper side. A "side opposite to the fitting side" includes, for example, a lower side. An "arrangement direction of the contacts 60" includes, for example, the left-right direction. A "direction substantially orthogonal to the arrangement direction of the contacts 60" includes, for example, the front-rear direction and a direction close thereto. A "protrusion direction of a protrusion 37" includes, for example, the front-rear direction.

The connector 10 according to the present embodiment has a floating structure. The connector 10 allows relative movement of the connection object 70 connected thereto with respect to the circuit board CB1. That is, the connection object 70 connected to the connector 10 may move within a predetermined range with respect to the circuit board CB1.

Figure 3:
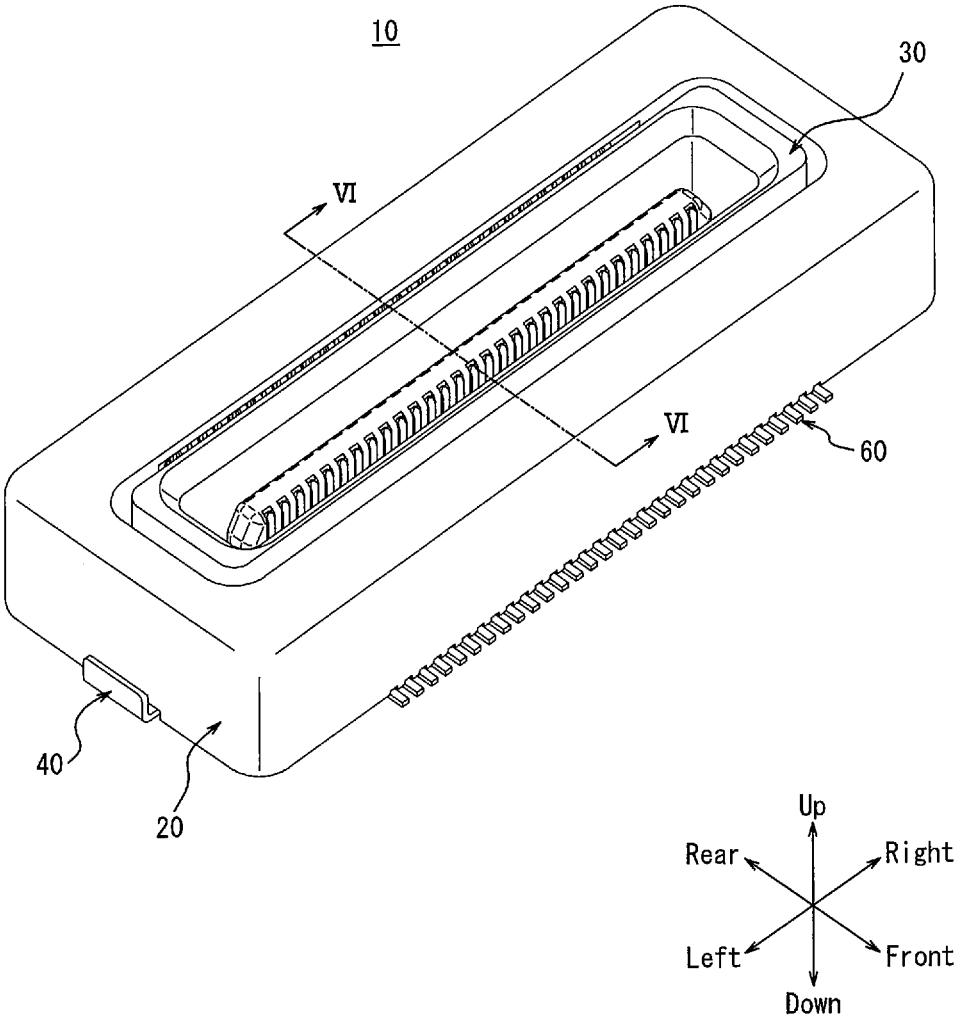
FIG. 3 is an external top perspective view illustrating the connector according to the embodiment.
Figure 4:
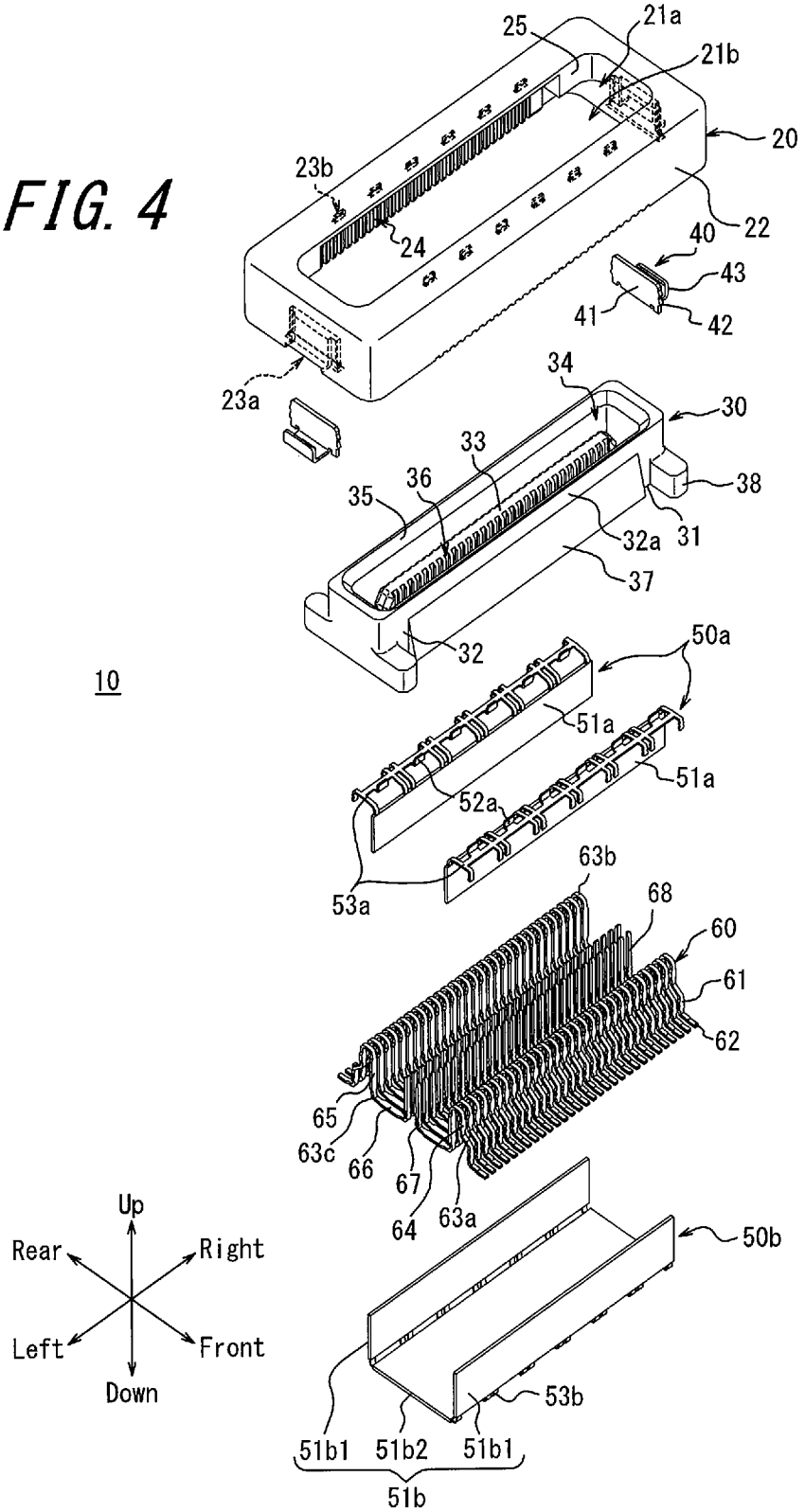
FIG. 4 is an exploded top perspective view of the connector of FIG. 3.
Figure 5:
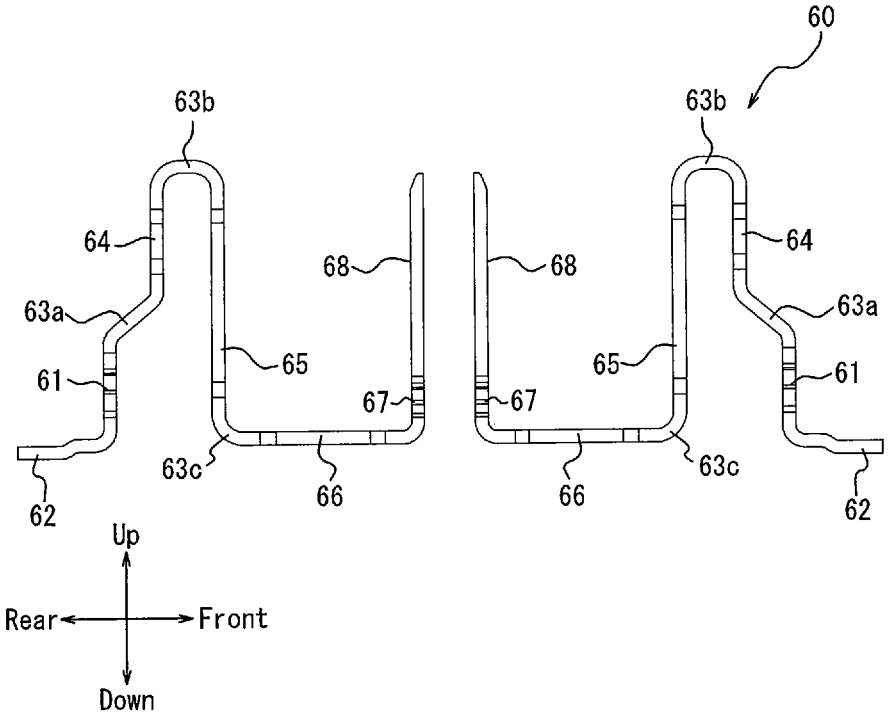
FIG. 5 is an elevation view of a pair of contacts.
Figure 6:
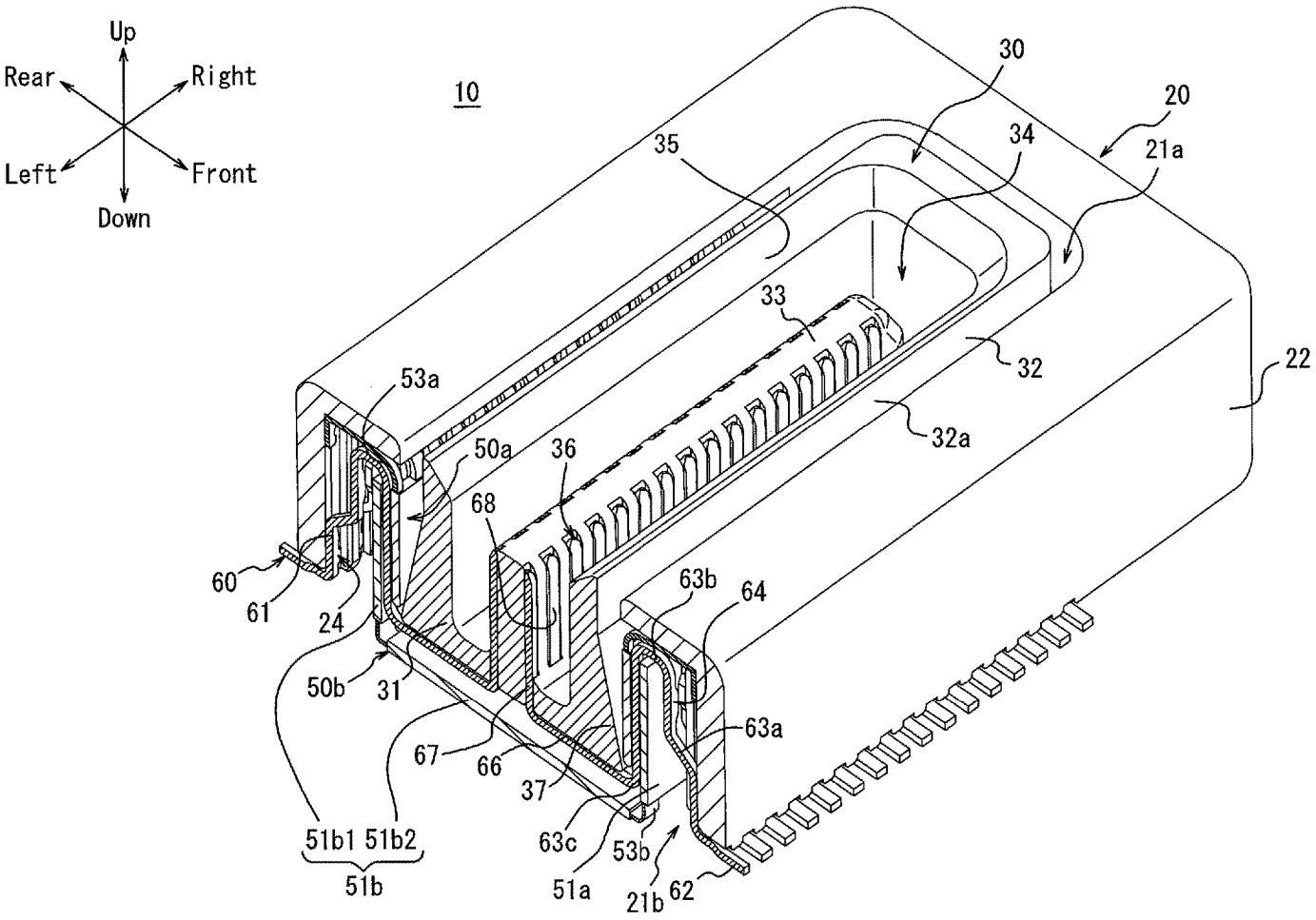
FIG. 6 is a perspective cross-sectional view taken from arrow VI-VI of FIG. 3.
Figure 7:
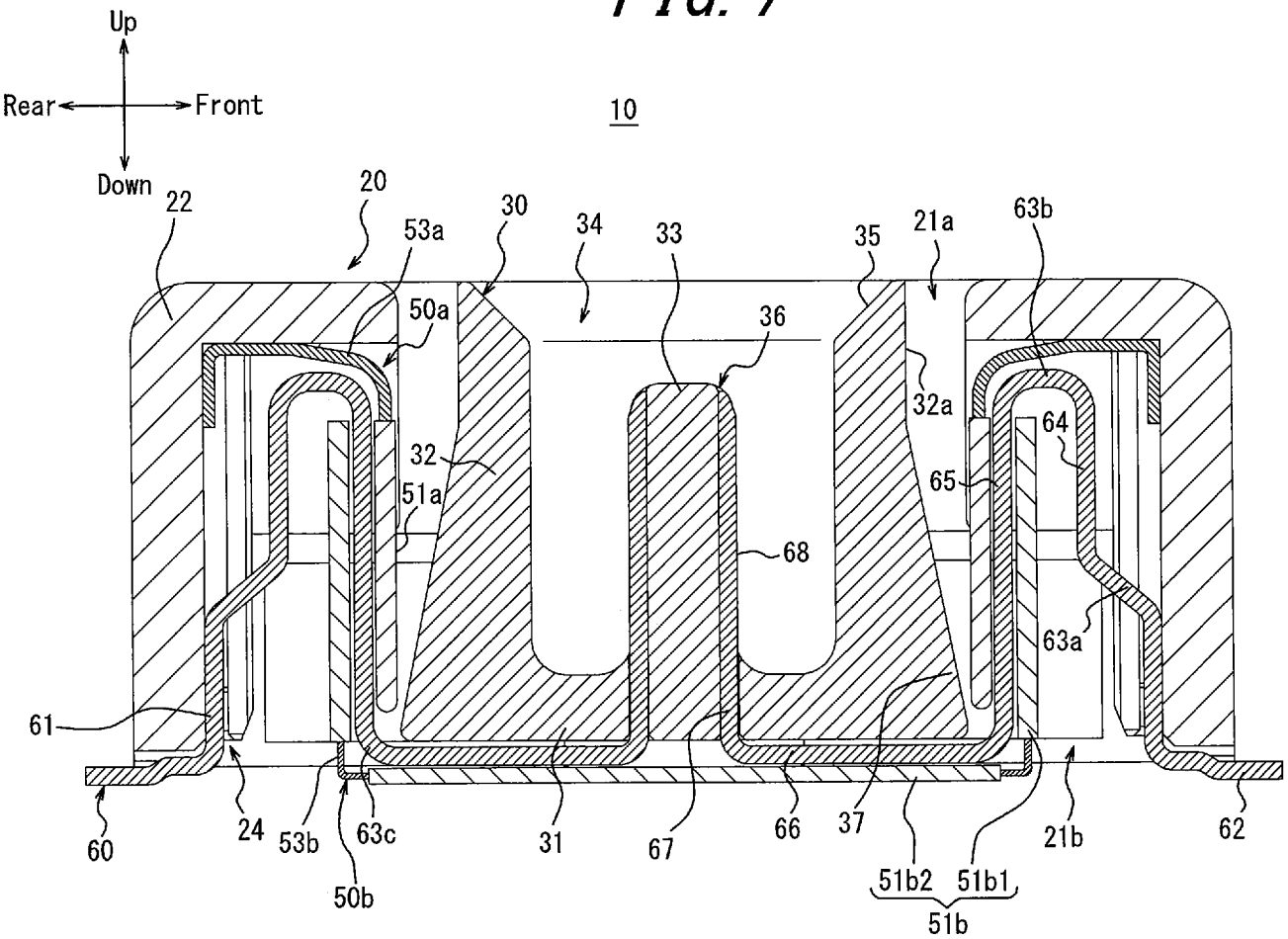
FIG. 7 is a cross-sectional view taken from arrow VI-VI of FIG. 3.

FIG. 3 is an external top perspective view illustrating the connector 10 according to the present embodiment. FIG. 4 is an exploded top perspective view of the connector 10 of FIG. 3. FIG. 5 is an elevation view of a pair of contacts 60. FIG. 6 is a perspective cross-sectional view taken from arrow VI-VI of FIG. 3. FIG. 7 is a cross-sectional view taken from arrow VI-VI of FIG. 3.

A configuration of the connector 10 according to the present embodiment in a state in which the contacts 60 do not elastically deform will be mainly described with reference to FIG. 3 to FIG. 7.

As illustrated in FIG. 4, the connector 10 includes, as main constituent elements, a first insulator 20, a second insulator 30, fitting brackets 40, adjustment members 50*a* and 50*b*, and contacts 60. The connector 10 is assembled in the following manner by way of example. The fitting brackets 40 and the adjustment members 50*a* are press-fitted into the first insulator 20 from below. The second insulator 30 is arranged in the first insulator 20 from below. The contacts 60 are press-fitted into the first insulator 20 and the second insulator 30 from below. The adjustment member 50*b* is inserted, from below, into the contacts 60 that are press-fitted into the first insulator 20 and the second insulator 30. The adjustment member 50*b* may be attached by any method. For example, the adjustment member 50*b* may have elasticity and may be attached by sandwiching a pair of the contacts 60 in a clip-like manner.

As illustrated in FIG. 4, FIG. 6, and FIG. 7, the first insulator 20 is a rectangular tubular member obtained by performing injection molding of a synthetic resin material having insulating and heat-resistant properties. The first insulator 20 is hollow and has an opening 21*a* and an opening 21*b* on its top surface and bottom surface, respectively. The first insulator 20 includes an outer peripheral wall 22 having four side surfaces surrounding the space therein. The first insulator 20 includes a first attachment groove 23*a* recessed upward within the first insulator 20 from the bottom surface in the left and right end portions of the outer peripheral wall 22. The fitting brackets 40 are attached to the respective first attachment groove 23*a*. The first insulator 20 includes second attaching grooves 23*b* recessed upward from the rear side of the top surface on the front and rear sides of the first insulator 20. Adjustment members 50*a* are attached to the second attachment grooves 23*b*.

The first insulator 20 includes a plurality of contact attachment grooves 24 formed in the lower edge portions of the front and rear surfaces of the outer peripheral wall 22 across the bottom surface and the inner surface. The plurality of contact attachment grooves 24 are formed in a recessed manner and arranged side by side in the left-right direction. The contact attachment grooves 24 extend in the up-down direction on the inner surface of the first insulator 20. Each of the plurality of contact attachment grooves 24 accommodates a corresponding one of the plurality of contacts 60.

The first insulator 20 includes four retainer portions 25 protruding inward in the front-rear direction and the left-right direction from the four corners of the outer peripheral wall 22. The retainer portions 25 inhibit upward displacement of the second insulator 30 from the first insulator 20.

The second insulator 30 is a member obtained by performing injection molding of a synthetic resin having insulating and heat-resistant properties and extends in the left-right direction. The second insulator 30 is formed in a substantially convex shape in side view from the left-right direction. The second insulator 30 includes a bottom 31 that constitutes a lower portion including a bottom surface. The second insulator 30 includes an outer peripheral wall 32 that includes four side surfaces surrounding the space therein.

The second insulator 30 includes a fitting protrusion 33 that protrudes upward from the bottom 31 and is to be fitted to the connection object 70. The second insulator 30 includes a fitting recess 34 formed in a recessed manner from the upper surface. The outer peripheral wall 32 surrounds the fitting protrusion 33 and the fitting recess 34 from the front-rear direction and the left-right direction. The fitting protrusion 33 is arranged within the fitting recess 34. The second insulator 30 includes a guiding portion 35 formed in the upper edge portion of the fitting recess 34 in such a manner as to surround the fitting recess 34. The guiding portion 35 includes an inclined surface inclined obliquely inward in the downward direction at the upper edge portion of the fitting recess 34.

The second insulator 30 includes a plurality of contact attachment grooves 36 formed on the bottom surface of the bottom 31 across the inside and the front and rear surfaces of the fitting protrusion 33. The plurality of contact attachment grooves 36 are formed in a recessed manner and arranged side by side in the left-right direction. The contact attachment groove 36 extends in the up-down direction from the bottom surface of the bottom 31 to the upper end of the fitting protrusion 33. Each of the plurality of contact attachment grooves 36 accommodates a corresponding one of the plurality of contacts 60.

The second insulator 30 includes a protrusion 37 protruding outward from each of the front and rear outer surfaces 32*a* of the outer peripheral wall 32. In particular, the protrusions 37 project towards the adjustment portions 51*a* from the outer surfaces 32*a* of the outer peripheral wall 32 which opposes the adjustment portions 51*a* of the adjustment members 50*a*, which will be described below. The protrusions 37 extend in the arranging direction of the contacts 60 in such a manner as to include the region in which the plurality of contacts 60 are arranged. The second insulator 30 is wider in the protruding directions of the protrusions 37 at the positions where the protrusions 37 are formed than the fitting side of the second insulator 30. The protrusions 37 includes an inclined surface inclined in the protruding direction of the protrusion 37 toward the side opposite to the fitting side. In particular, the protrusions 37 include an inclined surface inclined outward in the downward direction from the upper portions to the lower edge portions of the front and rear outer surfaces 32*a* of the outer peripheral wall 32.

The second insulator 30 includes two retained portions 38 protruding outward from the left and right end portions of the front and rear outer surfaces 32*a* of the outer peripheral wall 32. When the second insulator 30 excessively moves upward, the retained portions 38 come into contact with the retainer portions 25 of the first insulator 20.

As illustrated in FIG. 4, the fitting brackets 40 are obtained by molding a thin plate made of any metallic material into a shape as illustrated in the figure using a progressive die (stamping). Each fitting bracket 40 in its entirety is formed in a substantially J-shape in an elevation view from the front-rear direction. The fitting brackets 40 are press-fitted into the first attachment grooves 23*a* and arranged on each of the left and right end portions of the first insulator 20.

Each of the fitting brackets 40 includes a base 41 constituting a main body thereof and a latch 42 formed at each of the front and rear edge portions of the base 41. By latching of the latches 42 in the first attachment grooves 23*a* of the first insulator 20, the fitting brackets 40 are fixed to the first insulator 20. Each of the fitting brackets 40 includes a mounting portion 43 extending outward in a substantially U-shape from the base 41.

As illustrated in FIG. 4, FIG. 6, and FIG. 7, the adjustment members 50*a* are obtained by molding a thin plate made of any metallic material by using progressive die (stamping) and then partially covering the thin plate with an electrically insulating member. That is, each of the adjustment members 50*a* includes a member having electrical conductivity. The pair of adjustment members 50*a* are press-fitted into the second attaching groove 23*b* and arranged between the first insulator 20 and the second insulator 30 on the front and rear sides. In particular, the pair of adjustment members 50*a* are arranged between the pair of contacts 60 and the second insulator 30. The adjustment members 50*a* extend in the arranging direction of the contacts 60 in such a manner as to include the region in which the plurality of contacts 60 are arranged.

Each of the adjustment members 50*a* include an adjustment portion 51*a* to oppose the contacts 60 between the first insulator 20 and the second insulator 30. The adjustment portion 51*a* includes a metal member and a surface layer that has an electrical insulation property. The surface of the adjustment portion 51*a* which opposes the contacts 60 is a flat surface. The adjustment portion 51*a* extends in the arranging direction of the contacts 60 in such a manner as to include the region in which the plurality of contacts 60 are arranged.

Each of the adjustment members 50*a* includes, in the upper end portion thereof, a latch 52*a* to latch to the first insulator 20. By latching of the latch 52*a* in to the second attachment groove 23*b* of the first insulator 20, the adjustment member 50*a* is attached to the first insulator 20. Each of the adjustment members 50*a* includes a connecting portion 53*a* that connects the latch 52*a* and the adjustment portion 51*a* together. The connecting portion 53*a* is located on the fitting side with respect to the contacts 60 in the fitting direction of the connector 10 and the connection object 70. In particular, the connecting portion 53*a* is located between the first insulator 20 and the contacts 60 in the fitting direction.

The adjustment member 50*b* is obtained by molding a thin plate made of any metallic material using a progressive die (stamping) and then partially covering the thin plate with a member having an electrical insulation property. That is, the adjustment member 50*b* includes a member having electrical conductivity. The adjustment member 50*b* is formed in a substantially U-shape in side view in the left-right direction. The adjustment member 50*b* is arranged inside the first insulator 20. A portion of the adjustment member 50*b* is inserted into the contacts 60 from below and arranged between the first insulator 20 and the second insulator 30 on the front and rear sides. At this time, the remaining portion of the adjustment member 50*b* is located under the second insulator 30. The adjustment member 50*b* extends in the arranging direction of the contacts 60 in such a manner as to include the region in which the plurality of contacts 60 are arranged.

The adjustment member 50*b* includes an adjustment portion 51*b* which opposes the contacts 60. In particular, the adjustment portion 51*b* includes an adjustment portion 51*b*1 which opposes the contacts 60 between the first insulator 20 and the second insulator 30, and an adjustment portion 51*b*2 which opposes the contacts 60 under the second insulator 30. The adjustment member 51*b* includes a metal member and has a surface layer having an electrical insulation property. The surface of the adjustment portion 51*b* which opposes the contacts 60 is a flat surface. The adjustment portion 51*b* extends in the arranging direction of the contacts 60 in such a manner as to include the region in which the plurality of contacts 60 are arranged. The adjustment member 50*b* includes a connection portion 53*b* that connects the adjustment portion 51*b*1 and the adjustment portion 51*b*2 together.

As illustrated in FIG. 4 to FIG. 7, the contacts 60 are obtained by molding a thin plate made of for example, a copper alloy having spring elasticity such as phosphor bronze, beryllium copper, or titanium copper, or a Corson type copper alloy into the shape as illustrated in the figure by using a progressive die (stamping). The contacts 60 are made of a metallic material having a small elastic coefficient, so as to be largely deformed by elastic deformation. The surface of the contacts 60 is plated with gold or tin after application of a nickel plate undercoat.

As illustrated in FIG. 4, the plurality of contacts 60 are arranged in the left-right direction. As illustrated in FIG. 6 and FIG. 7, the contacts 60 are fitted to the first insulator 20 and the second insulator 30. A pair of contacts 60 arranged in the same positions on the left and right sides is symmetrically formed and arranged along a direction substantially orthogonal to the arranging direction of the contacts 60. In particular, the pair of contacts 60 is formed and arranged so as to be substantially linearly symmetric with respect to a vertical axis passing through the center between the pair of contacts 60.

Each of the contacts 60 include a first latch 61 that extends in the up-down direction. The first latch 61 latches to the first insulator 20. At this time, the first latch 61 is accommodated in the contact attachment groove 24 of the first insulator 20.

Each of the contacts 60 includes a mounting portion 62 that extends outward in a substantially L-shape from the bottom end portion of the first latch 61.

Each of the contacts 60 includes a first elastic portion 63*a* that curves inward from the top end portion of the first latch 61, extends obliquely upward, and then extends straight upward. The first elastic portion 63*a* is elastically deformable. Each of the contacts 60 includes a first connection portion 64 that is formed continuously with the first elastic portion 63*a* and linearly extends upward. Each of the contacts 60 includes a second elastic portion 63*b* that extends curving inward in a substantially inverted U-shape from the upper end portion of the first connection portion 64. The second elastic portion 63*b* is elastically deformable.

Each of the contacts 60 includes a second connection portion 65 that is formed continuously with the second elastic portion 63*b* and extends downward. The second connection portion 65 opposes the outer surface 32*a* in the front-rear direction of the outer peripheral wall 32 of the second insulator 30. The second connection portion 65 links the first insulator 20 and the second insulator 30 together. As illustrated in FIG. 4, the second connection portion 65 is wider in the left-right direction than the first elastic portion 63*a*, the second elastic portion 63*b*, and a third elastic portion 63*c*, which, will be described later.

Each of the contacts 60 includes the third elastic portion 63*c* that extends inward curving in a substantially L-shape from the bottom end portion of the second connection portion 65. The third elastic portion 63*c* is elastically deformable. Each of the contacts 60 includes a base 66 that extends inward from the third elastic portion 63*c* toward the inside of the connector 10.

Each of the contacts 60 includes a second latch 67 that extends in a substantially L-shape from the internal end portion of the base 66. The second latch 67 linearly extends inward in the front-rear direction from the base 66, bends substantially at right angles, and then linearly extends to the fitting side along the up-down direction. The second latch 67 latches to the second insulator 30. At this time, the second latch 67 is accommodated in the contact attachment groove 36 of the second insulator 30 in substantially its entirety. Each of the contacts 60 includes a contact portion 68 that is formed by the outer surfaces in the front-rear direction of the second latch 67 and comes into contact with the contacts 100 of the connection object 70 at the time of fitting. The contact portion 68 is exposed to the outside in the front-rear direction from the contact attachment groove 36 of the second insulator 30. The contact portion 68 opposes the second connection portion 65 in the front-rear direction. Thus, the profile of the contacts 60 is reduced. As a result, the profile of the connector 10 is reduced.

As illustrated in FIG. 4 and FIG. 6, the mounting portion 62, the first elastic portion 63*a*, the second elastic portion 63*b*, the third elastic portion 63*c*, and the contact portion 68 are narrower in the left-right direction than the remaining portion of the contact 60. This reduces the elastic moduli of the first elastic portion 63*a*, the second elastic portion 63*b*, and the third elastic portion 63*c* and yields a larger elastic deformation amount when a certain force is applied. On the other hand, a portion of the first latch 61, the first connection portion 64, the second connection portion 65, the base 66, and a portion of the second latch 67 are wider in the left-right direction than the remaining portion of the contact 60. This facilitates fixing of the first latch 61 and the second latch 67 in the first insulator 20 and the second insulator 30, respectively. Thus, the characteristic impedance of the first connection portion 64, the second connection portion 65, and the base 66 decreases, and the transmission characteristic of the contact 60 improves.

Between the first insulator 20 and the second insulator 30 as illustrated in FIG. 7, the adjustment portion 51*a* of the adjustment member 50*a* and the adjustment portion 51*b*1 of the adjustment member 50*b* oppose the contact 60 on both sides thereof in a direction substantially perpendicular to the fitting direction. In particular, the adjustment portion 51*a* and the adjustment portion 51*b*1 oppose the second connection portion 65 of the contact 60 from the inside and the outside, respectively, in the front-rear direction. That is, the second connection portion 65 of the contact 60 is located between the adjustment portion 51*a* and the adjustment portion 51*b*1 in the front-rear direction. Each of the adjustment portion 51*a* and the adjustment portion 51*b*1 is in close proximity to, or in contact with, the second connection portion 65. The distance between the adjustment portion 51*a* and the second connection portion 65 and the distance between the adjustment portion 51*b*1 and the second connection portion 65 are substantially the same in the up-down direction. That is, each of the adjustment portion 51*a* and the adjustment portion 51*b*1 is substantially parallel to the second connection portion 65.

Under the second insulator 30, the adjustment portion 51*b*2 of the adjustment member 50*b* opposes the base 66 of the contact 60 from below. That is, the base 66 of the contact 60 is located between the bottom 31 of the second insulator 30 and the adjustment portion 51*b*2 in the up-down direction. Each of the bottom 31 of the second insulator 30 and the adjustment portion 51*b*2 is in close proximity to, or in contact with, the base 66. The distance between the bottom 31 of the second insulator 30 and the base 66 and the distance between the adjustment portion 51*b*2 and the base 66 are substantially the same in the front-rear direction. That is, each of the bottom 31 of the second insulator 30 and the adjustment portion 51*b*2 is substantially parallel to the base 66.

In the connector 10 structured as described above, the mounting portion 62 of the contact 60 is soldered to the circuit pattern formed on the mounting surface of the circuit board CB1. The mounting portions 43 of the fitting brackets 40 are soldered to the ground pattern or the like formed on the mounting surface. In this way, the connector 10 is mounted on the circuit board CB1. On the mounting surface of the circuit board CB1, electronic components other than the connector 10 such as, for example, a CPU, a controller, a memory, and the like are mounted.

Figure 8:
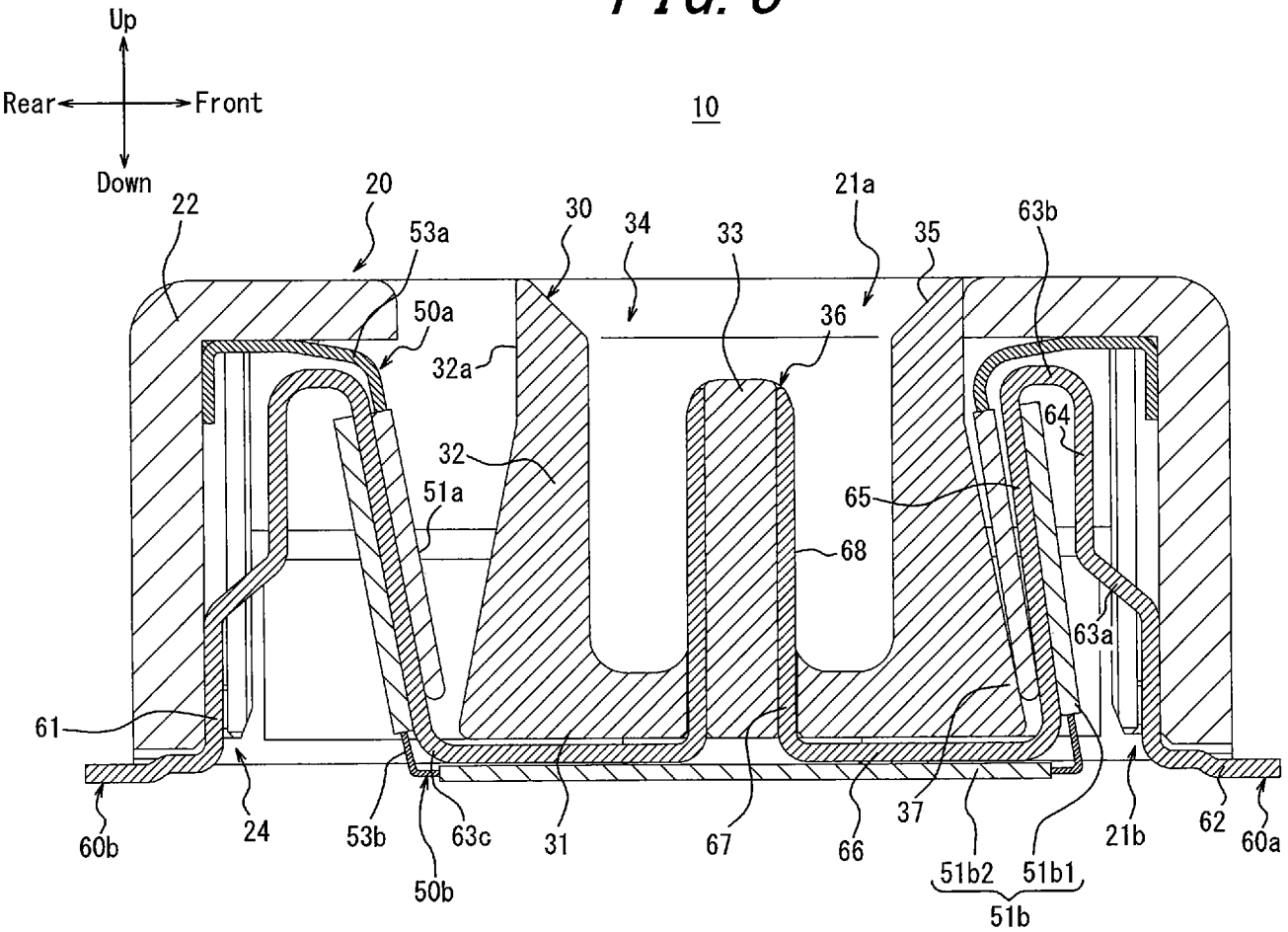
FIG. 8 is a cross-sectional view corresponding to FIG. 7 illustrating a first example of a movement of a second insulator.
Figure 9:
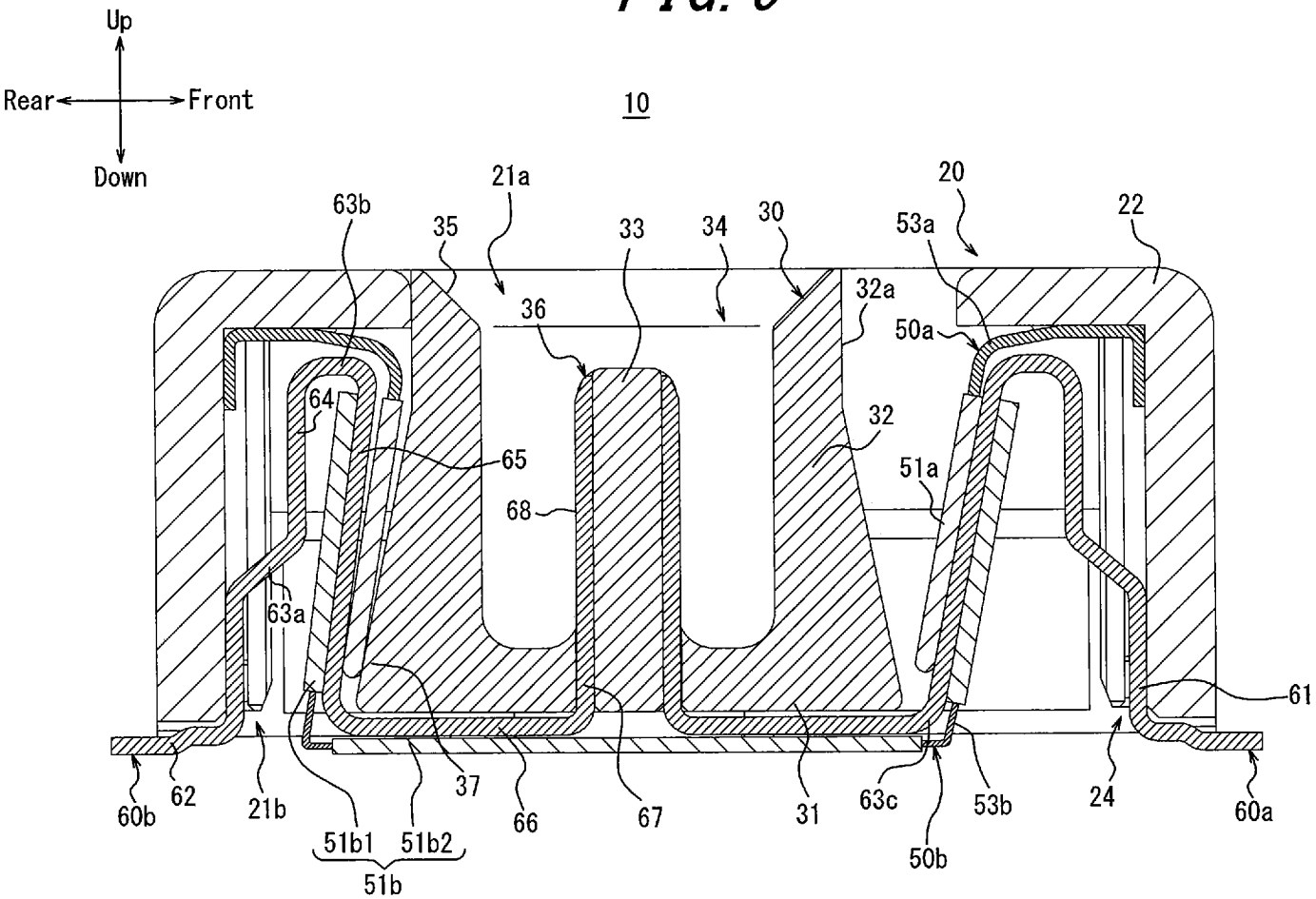
FIG. 9 is a cross-sectional view corresponding to FIG. 7 illustrating a second example of the movement of the second insulator.

FIG. 8 is a cross-sectional view corresponding to FIG. 7 illustrating a first example of a movement of the second insulator 30. FIG. 9 is a cross-sectional view corresponding to FIG. 7 illustrating a second example of the movement of the second insulator 30.

Operation of each constituent element when the pair of contacts 60 is elastically deformed will be mainly described with reference to FIG. 8 and FIG. 9. For the sake of simplicity of explanation, the contact 60 arranged on the front side is referred to as a contact 60*a*, and the contact 60 arranged on the rear side is referred to as a contact 60*b*.

In FIG. 8, it is assumed that the second insulator 30 is moved in the front direction by some external factor, by way of example.

When the second insulator 30 is moved in the front direction, the adjustment portion 51*a* of the adjustment member 50*a* on the front side, the second connection portion 65 of the contact 60*a*, and the adjustment portion 51*b*1 of the adjustment member 50*b* on the front side are pushed in the front direction by the protrusion 37 of the second insulator 30. This causes elastic deformation of the connecting portion 53*a* of the adjustment member 50*a*, and the adjustment portion 51*a* becomes inclined outward from the top to the bottom. Similarly, each elastic portion of the contact 60*a* is elastically deformed, and the second connection portion 65 becomes inclined outward from the top to the bottom. Further, the connecting portion 53*b* of the adjustment member 50*b* is elastically deformed, and the adjustment portion 51*b*1 becomes inclined outward from the top to the bottom.

When the second insulator 30 is moved in the front direction, the second connection portion 65 of the contact 60*b* is pulled in the front direction. This causes the adjustment portion 51*a* of the adjustment member 50*a* on the rear side to be pushed in the front direction by the second connection portion 65 of the contact 60*b*. The adjustment member 50*b* is attached to the connector 10 in a clip-like manner and thus tends to be elastically deformed in a constant manner toward the inside of the connector 10 by the connecting portion 53*b*. Thus, when the contact 60*b* is pulled in the front direction, the adjustment portion 51*b*1 moves in the front direction following the contact 60*b* because of the connecting portion 53*b* that applies an elastic force toward the inside of the connector 10. This causes elastic deformation of the connecting portion 53*a* of the adjustment member 50*a*, and the adjustment portion 51*a* becomes inclined inward from the top to the bottom. Similarly, each elastic portion of the contact 60*b* is elastically deformed, and the second connection portion 65 becomes inclined inward from the top to the bottom. Further, the connecting portion 53*b* of the adjustment member 50*b* is elastically deformed, and the adjustment portion 51*b*1 becomes inclined inward from the top to the bottom.

In FIG. 9, it is assumed that the second insulator 30 is moved in the rear direction by some external factor, by way of example.

When the second insulator 30 is moved in the rear direction, the adjustment portion 51*a* of the adjustment member 50*a* on the rear side, the second connection portion 65 of the contact 60*b*, and the adjustment portion 51*b*1 of the adjustment member 50*b* on the rear side are pushed in the rear direction by the protrusion 37 of the second insulator 30. This causes elastic deformation of the connecting portion 53*a* of the adjustment member 50*a*, and the adjustment portion 51*a* becomes inclined outward from the top to the bottom. Similarly, each elastic portion of the contact 60*b* is elastically deformed, and the second connection portion 65 becomes inclined outward from the top to the bottom. Further, the connecting portion 53*b* of the adjustment member 50*b* is elastically deformed, and the adjustment portion 51*b*1 becomes inclined outward from the top to the bottom.

When the second insulator 30 is moved in the rear direction, the second connection portion 65 of the contact 60*a* is pulled in the rear direction. This causes the adjustment portion 51*a* of the adjustment member 50*a* on the front side to be pushed in the rear direction by the second connection portion 65 of the contact 60*a*. The adjustment member 50*b* is attached to the connector 10 in the clip-like manner and thus tends to be elastically deformed in a constant manner toward the inside of the connector 10 by the connecting portion 53*b*. Thus, when the contact 60*a* is pulled in the rear direction, the adjustment portion 51*b*1 is moved in the rear direction following the contact 60*a* by the connecting portion 53*b* that applies an elastic force toward the inside of the connector 10. This causes elastic deformation of the connecting portion 53*a* of the adjustment member 50*a*, and the adjustment portion 51*a* becomes inclined inward from the top to the bottom. Similarly, each elastic portion of the contact 60*a* is elastically deformed, and the second connection portion 65 becomes inclined inward from the top to the bottom. Further, the connecting portion 53*b* of the adjustment member 50*b* is elastically deformed, and the adjustment portion 51*b*1 becomes inclined inward from the top to the bottom.

When the second insulator 30 is moved either in the front direction or in the rear direction, each of the adjustment portion 51*a* and the adjustment portion 51*b*1 stays substantially parallel to the second connection portion 65 of the contact 60. The relative positions of the adjustment portion 51*a*, the adjustment portion 51*b*1, and the second connection portion 65 stay substantially the same before and after the movement of the second insulator 30. Similarly, when the second insulator 30 moves either in the front direction or in the rear direction, each of the bottom 31 of the second insulator 30 and the adjustment portion 51*b*2 of the adjustment member 50*b* stay substantially parallel to the base 66 of the contact 60. The relative positions of the bottom 31, the adjustment portion 51*b*2, and the base 66 stay substantially the same before and after the movement of the second insulator 30.

Figure 10:
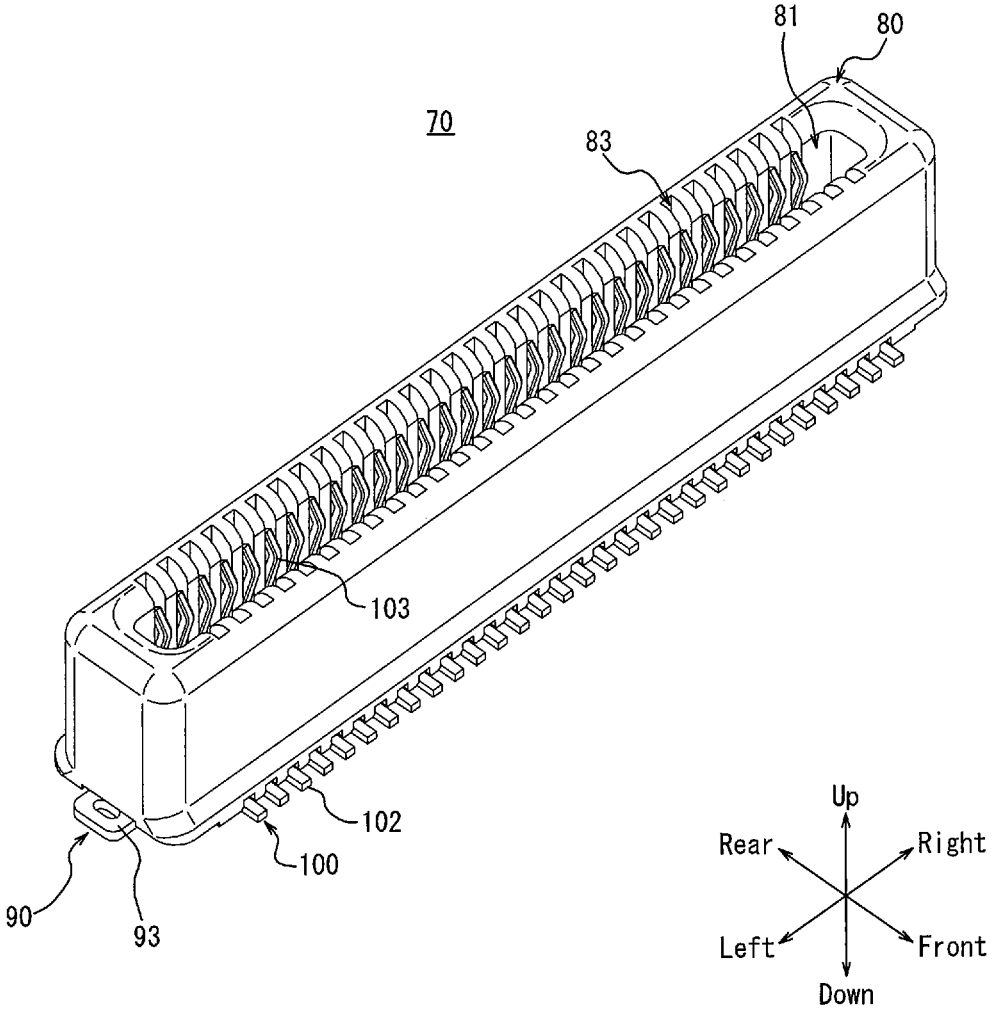
FIG. 10 is an external top perspective view of the connection object connected to the connector of FIG. 3.
Figure 11:
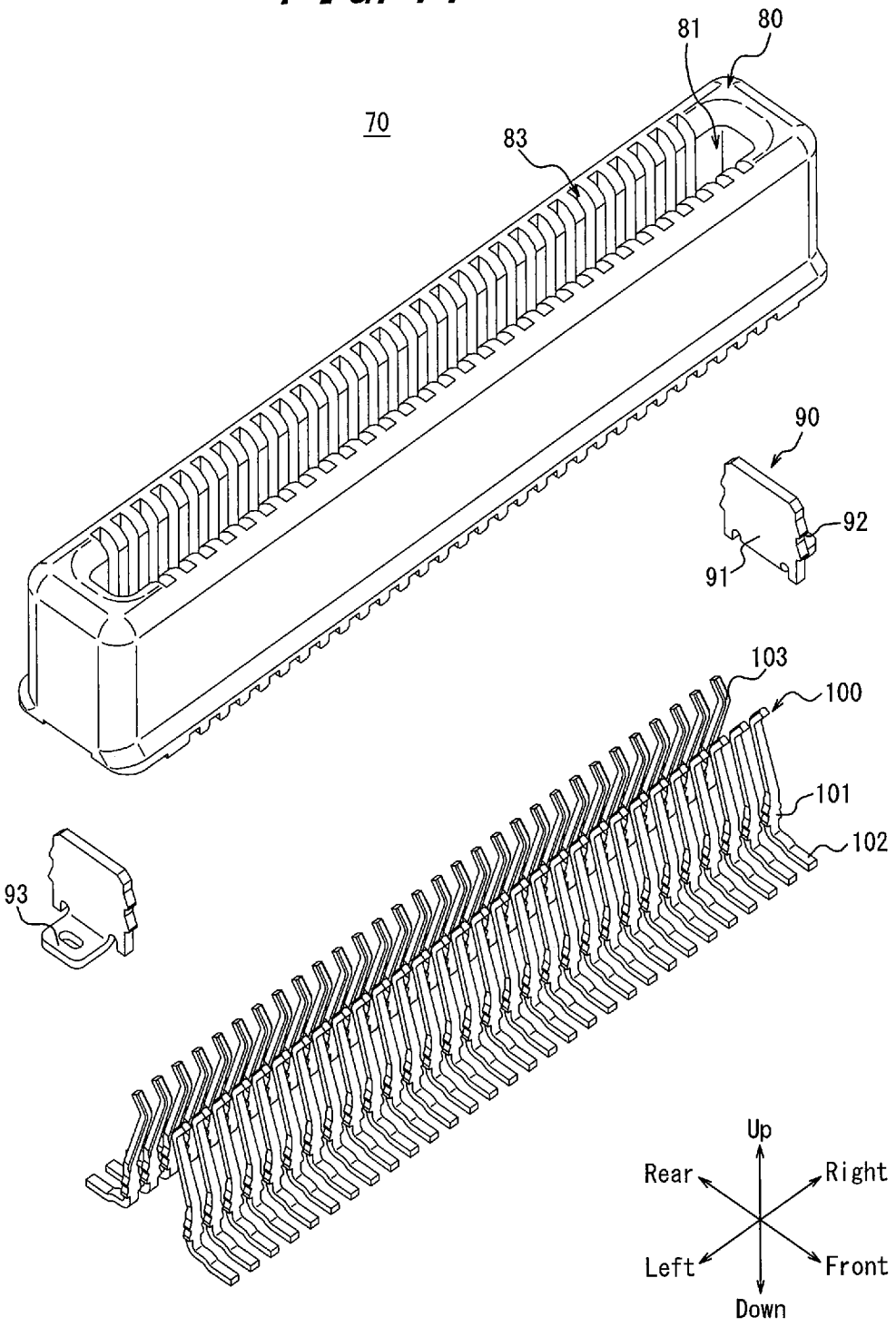
FIG. 11 is an exploded top perspective view of the connection object of FIG. 10.

FIG. 10 is an external top perspective view illustrating the connection object 70 to be connected to the connector 10 of FIG. 3. FIG. 11 is an exploded top perspective view of the connection object 70 of FIG. 10.

A configuration of the connection object 70 to be connected to the connector 10 according to one embodiment will be mainly described with reference to FIG. 10 and FIG. 11.

As illustrated in FIG. 11, the connection object 70 includes, as main constituent elements, an insulator 80, a fitting bracket 90, and contacts 100. The connection object 70 is assembled by, for example, press-fitting the fitting bracket 90 and the contacts 100 to the insulator 80 from below.

The insulator 80 is a member having a substantially quadrangular prism shape obtained by performing injection molding of a synthetic resin material having insulating and heat-resistant properties. The insulator 80 includes a fitting recess 81 formed on the top surface thereof. As illustrated in FIG. 2, the insulator 80 includes a fitting bracket attachment groove 82 formed in a recessed manner within the insulator 80 in left and right end portions of the bottom surface along the up-down direction. The fitting bracket attachment groove 82 accommodates the fitting bracket 90.

The insulator 80 includes a plurality of contact attachment grooves 83 continuously formed in a recessed manner over the front side of the bottom, the inside thereof, and the front surface of the fitting recess 81. The insulator 80 includes a plurality of contact attachment grooves 83 continuously formed in a recessed manner over the rear side of the bottom, the inside thereof, and the rear surface of the fitting recess 81. The plurality of contact attachment grooves 83 are formed side by side in a recessed manner in the left-right direction. The contact attachment grooves 83 extend along the up-down direction on the front and rear inner surfaces of the fitting recess 81. Each of the contact attachment grooves 83 accommodates a corresponding one of a plurality of contacts 100.

The fitting bracket 90 is formed by molding a thin plate made of any metallic material into the shape as illustrated in the figure by using a progressive die (stamping). The fitting bracket 90 is formed in a substantially L-shape in an elevation view in the front-rear direction. The fitting bracket 90 is press-fitted into the fitting bracket attachment groove 82 and arranged in each of the left and right end portions of the insulator 80.

Each of the fitting brackets 90 includes a base 91 constituting the main body thereof and a latch 92 formed on each of the front and rear edges of the base 91. By latching of the latch 92 to the fitting bracket attachment groove 82 of the insulator 80, the fitting bracket 90 is fixed in the insulator 80. Each of the fitting brackets 90 includes a mounting portion 93 extending outward in a substantially L-shape from the base 91.

The contacts 100 are obtained by molding a thin plate made of a copper alloy having spring elasticity such as phosphor bronze, beryllium copper, or titanium copper, or a thin plate of Corson type copper alloy into the shape as illustrated in the figure by using the progressive die (stamping). The surface of the contact 100 is plated with gold or tin after application of a nickel plate undercoat.

The plurality of contacts 100 are arranged along the left-right direction. Each of the contacts 100 includes a latch 101 formed to be wider in the left-right direction than the remaining portion. The latch 101 is fixed in the contact attachment groove 8 of the insulator 80. Each of the contacts 100 includes a mounting portion 102 that extends outwardly in a substantially L-shape from the lower end portion of the latch 101. Each of the contacts 100 includes an elastic contact portion 103 that extends upward in a substantially dogleg shape from the upper end portion of the latch 101. The bent portion of the elastic contact portion 103 contacts the contact portion 68 of a respective contact 60 of the connector 10 during fitting. The elastic contact portion 103 is elastically deformable along the front-rear direction.

In the connection object 70 having the above structure, the mounting portion 102 of each of the contacts 100 is soldered to the circuit pattern formed on the mounting surface of the circuit board CB2. The mounting portion 93 of each of the fitting brackets 90 is soldered to the ground pattern or the like formed on the mounting surface. In this way, the connection object 70 is mounted on the circuit board CB2. On the mounting surface of the circuit board CB2, electronic components other than the connection object 70 including, for example, a camera module, a sensor, and the like are mounted.

Figure 12:
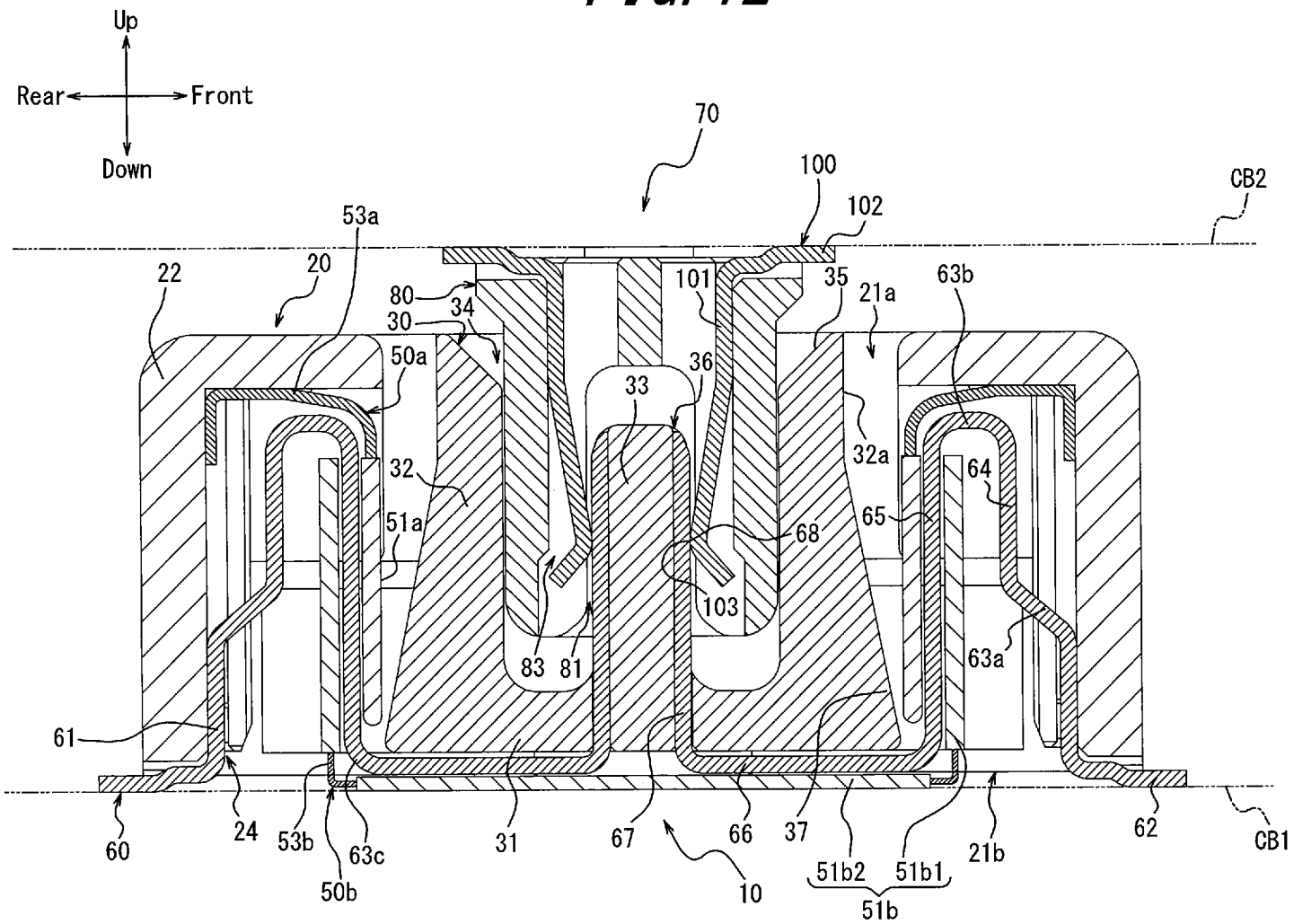
FIG. 12 is a cross-sectional view taken from arrow XII-XII of FIG. 1.

FIG. 12 is a cross-sectional diagram taken along arrow XII-XII of FIG. 1.

The operation of the connector 10 having the floating structure when the connection object 70 is connected to the connector 10 will be mainly described with reference mainly to FIG. 12.

The contacts 60 of the connector 10 support the second insulator 30 within the first insulator 20 in a state in which the second insulator 30 is spaced apart from the first insulator 20 and floating. At this time, the second insulator 30 is surrounded by the outer peripheral wall 22 of the first insulator 20.

When the mounting portions 62 of the contacts 60 are soldered to the circuit board CB1, the first insulator 20 is fixed to the circuit board CB1. The second insulator 30 is movable relative to the first insulator 20 fixed to the circuit board CB1 when the first elastic portion 63*a*, the second elastic portion 63*b*, and the third elastic portion 63*c* of each of the contacts 60 are elastically deformed.

At this time, the inner surface in the left-right direction of the outer peripheral wall 22 of the first insulator 20 inhibits excessive movement of the second insulator 30 in the left-right direction with respect to the first insulator 20. When, due to elastic deformation of the contacts 60, the second insulator 30 moves by an amount in the left-right direction which exceeds a design value, the outer surface of the outer peripheral wall 32 of the second insulator 30 which opposes the inner surface of the outer peripheral wall 22 of the first insulator 20 comes into contact with the inner surface. As a result, the second insulator 30 cannot move further outward in the left-right direction.

Similarly, at least one of the inner surfaces of the outer peripheral wall 22 of the first insulator 20 opposing the retained portion 38 of the second insulator 30 and the peripheral portion of the opening 21*a* of the first insulator 20 inhibits excessive movement of the second insulator 30 in the front-rear direction relative to the first insulator 20. When, due to elastic deformation of the contact 60, the second insulator 30 moves by an amount in the front-rear direction which exceeds a design value, at least one of the retained portion 38 of the second insulator 30 and the outer peripheral wall 32 come into contact with the inner surface of the outer peripheral wall 22 of the first insulator 20 and the peripheral portion of the opening 21*a* described above, respectively. As illustrated in FIG. 8 and FIG. 9, for example, when the second insulator 30 moves by a large amount in the front-rear direction, the outer peripheral wall 32 of the second insulator 30 comes into contact with the peripheral portion of the opening 21*a* of the first insulator 20. Thus, the second insulator 30 cannot move further outward in the front-rear direction.

As illustrated in FIG. 2, in a state in which the connection object 70 is turned upside down with respect to the connector 10 having the floating structure as described above, the connector 10 and the connection object 70 are arranged in the up-down direction to oppose to each other in such a manner that the front and rear positions and the right and left positions substantially match to one another. Then, the connection object 70 is moved downward. At this time, even if these positions are slightly deviated from one another in, for example, the front-rear direction and the right-and-left direction, the guiding portion 35 of the connector 10 and the connection object 70 come into contact with each other, and thus the second insulator 30 moves relative to the first insulator 20 because of the floating structure of the connector 10. In this way, the connection object 70 is guided into the fitting recess 34 of the second insulator 30.

When the connection object 70 is moved further downward, the fitting protrusion 33 of the connector 10 and the fitting recess 81 of the connection object 70 are fitted together. The fitting recess 34 of the connector 10 and the insulator 80 of the connection object 70 are fitted together. In this state, the contact portions 68 of the contacts 60 and the elastic contact portions 103 of the contacts 100 come into contact with each other. At this time, the elastic contact portions 103 of the contacts 100 are elastically deformed slightly outward within the contact attachment grooves 83.

In this way, the connector 10 and the connection object 70 are fully connected together. At this time, the circuit board CB1 and the circuit board CB2 are electrically coupled via the contacts 60 and the contacts 100.

In this state, each pair of elastic contact portions 103 of the contacts 100 clamps the respective pair of the contacts 60 of the connector 10 from front and rear sides thereof due to an inward elastic force along the front-rear direction. By virtue of a reaction to the pressing force applied to the contact 60 in this manner, the second insulator 30 is subject to an upward force via the contact 60 when the connection object 70 is removed from the connector 10. Thus, when the second insulator 30 is moved upward, the retainer portion 25 of the first insulator 20 inhibits the second insulator 30 from moving upward and becoming removed from the first insulator 20. The retainer portion 25 of the first insulator 20 overlaps the retained portion 38 of the second insulator 30 in the bottom view. Thus, when the second insulator 30 is pushed upward, the retained portion 38 protruding outward from the outer surface 32*a* of the outer peripheral wall 32 comes into contact with the retainer portion 25. As a result, the second insulator 30 cannot move further upward.

According to the present embodiment as described above, the connector 10 having the floating structure and a reduced profile can improve the transmission characteristic in a signal transmission. The adjustment members 50*a* and 50*b* include the adjustment portions 51*a* and 51*b*, respectively, which oppose the contacts 60. Thus, each of the adjustment portions 51*a* and 51*b* comes in close proximity to, or contacts, the corresponding portions of the contacts 60. As a result, the characteristic impedance of the contacts 60 decreases near each adjustment portion. In particular, when a member having electrical conductivity included in each adjustment portion is brought into close proximity to the contact 60 across the electrically insulating member on the surface layer, the same effect as that of the capacitor can be obtained therebetween. When C represents the electrostatic capacitance, a characteristic impedance Z at this time depends on the electrostatic capacitance C. For example, the characteristic impedance Z is in inverse proportion to the square root of the capacitance C or to the electrostatic capacitance C. Accordingly, the characteristic impedance is reduced when the electrostatic capacitance is increased C by reducing the interval between the capacitors. By adjusting the value of the characteristic impedance to the ideal value as described above, the transmission characteristic in a signal transmission can be improved.

Because the adjustment portions 51*a* and 51*b*1 oppose the second connection portions 65 of the contacts 60 from the inside and the outside, respectively, in the front-rear direction, the same effect as that of the capacitor can be obtained on both sides of the second connection portion 65. Thus, the characteristic impedance of the contact 60 is further reduced, and the transmission characteristic in a signal transmission is further improved.

Because the adjustment portions 51*a* and 51*b* extend in the arranging direction of the contacts 60, each of the adjustment portions is brought into close proximity to, or into contact with each other across the plurality of contacts 60 arranged in the left-right direction. Thus, the characteristic impedance of each of the contacts 60 is reduced. As a result, the transmission characteristic of the signal transmission of each of the contacts 60 is further improved. Further, there is no need to individually form the adjustment portion for each contact 60, thus improving productivity of the adjustment members 50*a* and 50*b*. As a result, the productivity of the connector 10 is improved.

Because the adjustment portions 51*a* and 51*b* extend in the arranging direction of the contacts 60, the member having electrical conductivity included in each of the adjustment portions also functions as a shielding member against electromagnetic noise. Thus, the transmission characteristics are improved also in large capacity and high-speed signal transmission. In particular, the impact of noise on the transmission signal of the portion in which each of the adjustment portions are opposed to each other in the contact 60 is reduced. For example, when each of the adjustment portions suppresses noise such as magnetism flowing out from the connector 10, the electrical influence on the electronic parts mounted around the connector 10 by the signal transmitted by the contact 60 is reduced.

Because each of the adjustment portions 51*a* and 51*b* includes a metal member and has the electrical insulation property in the surface layer, the metal member and the contact 60 can demonstrate the same effect as the capacitor and, simultaneously, electrical insulation between the metal member and the contact 60 can be ensured. For example, when the second insulator 30 moves, the adjustment portions and the corresponding portions of the contact 60 are likely to come into contact with one another. Even in such a case, electrical insulation between the metallic member and the contact 60 is secured, and electrically induced troubles such as a short circuit are avoided. Thus, when the connector 10 and the connection object 70 are coupled together, the connection reliability is improved.

Because each of the surfaces of the adjustment portions 51*a* and 51*b* opposing the contacts 60 is a flat surface, deformation and breakage of each constituent element due to the contact between the adjustment portions and the corresponding portions of the contacts 60 are inhibited. For example, when the second insulator 30 moves, each of the adjustment portions and the corresponding portions of the contact 60 are likely to come into contact with one another. In this case also, mechanical problems caused by the contact between each of the adjustment portions and the corresponding portions of the contacts 60 are reduced. In particular, when the second insulator 30 moves, the contacts 60 and each of the adjustment portions come into contact with one another and inhibit deformation of the contact 60. Alternatively, scraping of each of the adjustment members or the contacts 60 is inhibited. Thus, when the connector 10 and the connection object 70 are connected together, the connection reliability is improved.

Because the latches 52*a* of the adjustment members 50*a* are latched to the first insulator 20, the adjustment members 50*a* may be arranged between the first insulator 20 and the second insulator 30 in a more secured manner than when the latches 52*a* are fixed to the second insulator 30 that moves. For example, this inhibits one of the pair of adjustment members 50*a* fixed in the second insulator 30 from coming off the contact 60 when the second insulator 30 moves. Because the latches 52*a* are fixed to the first insulator 20, the relative position between the adjustment members 50*a* and the contact 60 is stabilized.

Because the connecting portions 53*a* are located on the fitting side with respect to the contact 60, the connecting portions 53*a* of the adjustment members 50*a* and the corresponding portions of the contacts 60 overlap each other along the front-rear direction. This reduces the width of the connector 10 in the front-rear direction, and thus downsizes the connector 10. Also, the connecting portions 53*a* are elastically deformed when the adjustment portions 51*a* move, so that the relative position is adjusted to inhibit the formation of a large gap between the adjustment portions 51*a* and the second connection portions 65 of the contacts 60. Accordingly, the characteristic impedance of the contact 60 caused by the change in the distance between the adjustment portions 51*a* and the contact 60 is reduced.

Because the second insulator 30 includes the protrusions 37 that protrude from the outer surfaces 32*a* of the outer peripheral walls 32 opposing the adjustment portions 51*a* toward the adjustment portions 51*a*, when the second insulator 30 moves, one of the protrusions 37 and one of the adjustment portions 51*a* come into contact with each other as illustrated in FIG. 8 and FIG. 9. This enables, when the second insulator 30 moves, the protrusions 37 to push the adjustment portions 51*a* such that the gap between the one of the adjustment portions 51*a* and the contact 60 is reduced to inhibit them from largely separating from each other. Thus, the change in the characteristic impedance of the contact 60 caused by the change in the distance between the adjuster 51*a* and the contact 60 is reduced.

Because the protrusions 37 protrude in the front-rear direction from the outer surfaces 32*a* of the outer peripheral walls 32 of the second insulator 30, the protrusions 37 come into close proximity to the second connection portions 65 of the contacts 60, whereby the characteristic impedance of the contacts 60 is reduced near the protrusions 37. In particular, because the protrusions 37 of the second insulator 30 having higher dielectric constant than the air are brought into close proximity to the contacts 60, the same effect as that of a capacitor can be obtained. As described above, thus, the transmission characteristic of signal transmission is improved by approximating the value of the characteristic impedance to the ideal value.

Because the second insulator 30 is formed to be wide at the positions where the protrusions 37 are formed, the strength of the second insulator 30 is improved. Also, because the center of gravity of the second insulator 30 is lowered, the second insulator 30 moves stably during the floating operation of the connector 10. On the other hand, because the second insulator 30 is narrow on the fitting side, the distances between the outer surfaces 32*a* of the outer peripheral walls 32, the first insulator 20, and the adjustment member 50*a* on the fitting side are increased. This inhibits the second insulator 30 from coming into contact with the first insulator 20 and the adjustment member 50*a* on the fitting side when the second insulator 30 moves, and maintains the movable amount of the second insulator 30 required for the floating operation of the connector 10.

Because the bottom surface of the protrusions 37 is substantially parallel to the bases 66 of the contacts 60, the same effect as a capacitor can be obtained between the protrusion 37 and the bases 66. Thus, the characteristic impedance of the bases 66 can be easily adjusted by adjusting the distance between the bottom surface of the protrusions 37 and the bases 66. For example, it is also possible to increase the electrostatic capacitance C and reduce the characteristic impedance by bringing the bottom surface of the protrusion 37 and the bases 66 close to each other.

Because each of the contacts 60 includes the second connection portion 65 which is wider than the second elastic portion 63*b* and the third elastic portion 63*c* adjacent thereto, the characteristic impedance of the second connection portion 65 is reduced. This suppresses an increase in the characteristic impedance of these elastic portions and approximates the average value of the entire characteristic impedance to the ideal value. In this way, the connector 10 can contribute to characteristic impedance matching. Thus, the connector 10 can obtain a desired transmission characteristic for a high capacity and high-speed transmission.

Because the fitting brackets 40 are press-fitted into the first insulator 20 and the mounting portion 43 is soldered to the circuit board CB1, the fitting brackets 40 can stably fix the first insulator 20 to the circuit board CB1. The fitting brackets 40 improve the mounting strength of the first insulator 20 to the circuit board CB1.

Because the contacts 60 is made of a metal material having a small elastic coefficient, the connector 10 can secure the necessary movement amount of the second insulator 30 even when a small force is applied to the second insulator 30. That is, the second insulator 30 can smoothly move with respect to the first insulator 20. This enables the connector 10 to easily accommodate the positional deviation when engaging with the connection object 70. In the connector 10, each of the elastic portions of the contacts 60 cancels vibrations caused by some external factor. This reduces the possibility that a large force is applied to the mounting portion 62. Thus, breakage of a contact portion between the connector 10 and the circuit board CB1 is inhibited. That is, cracking in the solder in the connection portion between the circuit board CB1 and the mounting portion 62 can be inhibited. Thus, when the connector 10 and the connection object 70 are connected together, the connection reliability is improved.

It will be apparent to those who are skilled in the art that the present disclosure may be realized in forms other than the embodiment described above, without departing from the spirit and the fundamental characteristics of the present disclosure. Accordingly, the foregoing description is merely illustrative and not limiting in any manner. The scope of the present disclosure is defined by the appended claims, not by the foregoing description. Among all modifications, those within a range of the equivalent to the present disclosure shall be considered as being included in the present disclosure.

For example, the shapes, arrangements, orientations, numbers, and the like of the constituent elements described above are not limited to those in the above description and drawings. Any shape, arrangement, orientation, number, and the like of the constituent elements that realize the functions thereof may be used.

The method of assembling the connector 10 and the connection object 70 is not limited to the manner in the above description. Any assembly method of the connector 10 and the connection object 70 that substantializes the respective functions may be employed. For example, at least one of the fitting brackets 40, the adjustment member 50*a*, and the contact 60 may be molded integrally with at least one of the first insulator 20 and the second insulator 30 by performing insert molding, instead of being press-fitted thereto.

Figure 13:
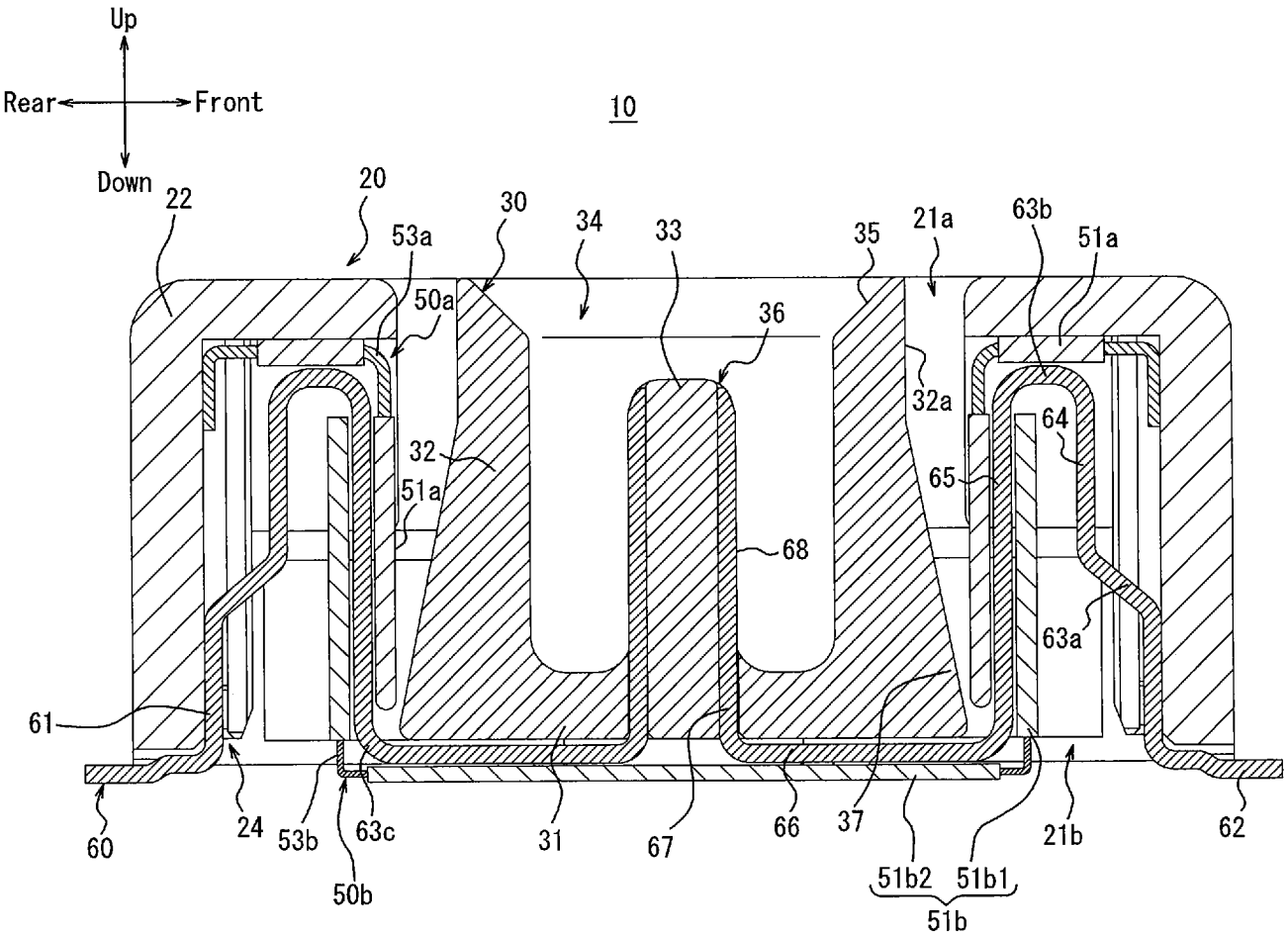
FIG. 13 is a cross-sectional view corresponding to FIG. 7 illustrating an example variation of an adjustment member.

FIG. 13 is a cross-sectional view corresponding to FIG. 7 illustrating an example variation of the adjustment members 50*a*. The adjustment portion 51*a* of each of the adjustment members 50*a* may be further formed on the fitting side with respect to the contact 60 in the fitting direction, in addition to the space between the first insulator 20 and the second insulator 30. In this case, the adjustment portions 51*a* oppose the contacts 60 between the first insulator 20 and the second insulator 30 and above the contacts 60. This increases the area in which the adjustment portions 51*a* of the adjustment members 50*a* oppose the contacts 60, and further reduces the characteristic impedance of the contacts 60. Consequently, the transmission characteristics of signal transmission are further improved.

Although the adjustment members 50*a* and 50*b* have been described as opposing the contacts 60 between the first insulator 20 and the second insulator 30 and under the second insulator 30, this is not restrictive. The adjustment members 50*a* and 50*b* may oppose the contact 60 in any position within the first insulator 20. For example, the adjustment members 50*a* and 50*b* may oppose the contact 60 between the first insulator 20 and the second insulator 30 or under the second insulator 30.

Although the adjustment portions 51*a* and 51*b*1 have been described as opposing the contacts 60 from both sides in the front-back direction, this is not restrictive. Only one of the adjustment portions 51*a* and 51*b*1 may face the contact 60.

Although the adjustment members 50*a* and 50*b* have been described as individual members, the adjustment members are not limited to this configuration. Each of the adjustment members 50*a* and 50*b* may have any configuration that can realize its function. For example, the adjustment members 50*a* and 50*b* may be integrally formed as one continuous adjustment member.

Each of the adjustment portions may be formed by any manner so as to include a metal member and has electric insulation in the surface layer. For example, each of the adjustment portions may be formed by performing insert molding for integrally forming a metal member and a resin material, by performing insulation plating to the surface of the metal member, or by covering the metal member with an insulation sheet. Each of the adjustment portions may be formed only by using a metal member when it can secure the insulating property with respect to the contact 60.

Although the surface of each of the adjustment portions which opposes the contacts 60 has been described as a flat surface, this is not restrictive. Any structure such as a groove or a through hole for accommodating the corresponding portion of the respective contact 60 when the respective contact 60 is elastically deformed may be added to the surface of each of the adjustment portions opposing the contact 60.

Each of the connecting portion 53*a* and the connecting portion 53*b* may be made of any material. As with the adjustment portions, for example, each of the connection portions may include a metal member and may have electrical insulation in the surface layer, or may be made of any one of metal and resin.

Although the adjustment members 50*a* have been described as being fixed in the first insulator 20 by the latches 52*a*, this is not restrictive. The adjustment members 50*a* may be arranged within the first insulator 20 in any manner. For example, the adjustment members 50*a* may be directly adhered to the contacts 60 using any adhesive including glue or the like. For example, the adjustment members 50*a* may be integrally formed with the contacts 60 by insert molding. For example, the adjustment members 50*a* may be formed continuously with a metallic shielding member arranged along the outer surface of the outer peripheral walls 22 of the first insulator 20 in such a manner as to hang inward from the opening 21*a* via the top surface of the first insulator 20.

Although the protrusions 37 have been described as including the inclined surfaces from the upper portions to the lower edge portions of the outer surfaces 32*a* of the outer peripheral walls 32, this is not restrictive. The protrusions 37 may have any configuration that can push the adjustment portions 51*a* and improve the transmission characteristics of the signal transmission of the connector 10. For example, the protrusions 37 may include an inclined surface inclined across the top to the lower edge portion of the outer surface 32*a* of the outer peripheral wall 32. For example, the protrusions 37 may be formed to protrude outwardly from the outer peripheral wall 32 in a stepped manner including an outer surface parallel to the up-down direction. For example, the protrusions 37 may protrudes outward from the outer peripheral wall 32 in such a manner as to include a curved surface.

Although in the above description the increase in the width of the transmission path, i.e., the cross-sectional area of the transmission path in each of the first connection portions 64, the second connection portions 65, and the bases 66 reduces the characteristic impedance and thus improves the transmission characteristic of the contacts 60, each constituent element is not limited to such a configuration. Each of the first connection portions 64, the second connection portions 65, and the bases 66 may have any configuration that improves the electrical conductivity. For example, each constituent element may be formed to have the same width as the other portions of the contact 60. For example, each constituent element may be made of a material having a higher electric conductivity than the other portions of the respective contact 60 and having the same cross-sectional area. For example, each constituent element may have the same cross-sectional area as the other portions of the respective contact 60 and include the surface plated with a material that improves electrical conductivity.

The second connection portions 65 may be bent in a substantially dogleg shape toward the second insulator 30. This increases the movable amount of the second insulator 30 necessary for the floating operation of the connector 10. Further, the profile of the connector 10 is reduced.

Although the first elastic portion 63*a*, the second elastic portion 63*b*, and the third elastic portion 63*c* have been described above as being narrower than the other portions of the respective contacts 60, this is not restrictive. Each of the elastic portions may have any configuration that can secure the necessary elastic deformation amount. For example, each of the elastic portions may have the same width and may be made of a metal material having a smaller elastic coefficient than the other portion of the respective contact 60.

Although the contacts 60 has been described as being made of a metal material having a small elastic coefficient, this is not restrictive. The contacts 60 may be made of any metal material having any elastic modulus that can secure the necessary elastic deformation amount.

Although the connection object 70 has been described as a receptacle connector connected to the circuit board CB2, this is not restrictive. The connection object 70 may be any object other than a connector. For example, the connection object 70 may be an FPC, a flexible flat cable, a rigid board, or a card edge of any circuit board.

The connector 10 described above is mounted in an electronic device. The electronic device includes, for example, any in-vehicle device such as a camera, a radar, a drive recorder, or an ECU (engine control unit). The electronic device includes any in-vehicle device used in an in-vehicle system such as a GPS navigation system, an advanced driving support system, or a security system. The electronic device includes, for example, any information device such as a personal computer, a copy machine, a printer, a facsimile, or a multifunction machine. The electronic equipment also includes any industrial equipment.

The electronic device as described above maintains excellent transmission characteristics of signal transmission even when miniaturized. The floating structure of the connector 10 accommodates positional deviation between the substrates in an excellent manner and thus improves workability when assembling the electronic device. That is, easier manufacture of the electronic device is facilitated. The connector 10 inhibits damage to the connection portion thereof to the circuit board CB1 and thus improves the reliability of the electronic device as a product. Similarly, because the above-described electrical problems and mechanical defects in the connector 10 are inhibited, the connection reliability with respect to the connection object 70 is improved, and the reliability of the electronic device as a product is further improved.

The invention claimed is:

1. A connector to be fitted to a connection object, said connector comprising:

a first insulator;

a second insulator movable relative to said first insulator;

a contact attached to said first insulator and said second insulator, said contact including a connection portion configured to link said first insulator and said second insulator together; and an adjustment member having electrical conductivity arranged within said first insulator, wherein said adjustment member includes an adjustment portion configured to oppose said contact, and wherein said adjustment portion is configured to oppose said connection portion on both sides of an inside and an outside in a direction substantially orthogonal to a fitting direction of said connector and said connection object.

2. The connector according to claim 1, wherein said adjustment portion is located on a fitting side with respect to said contact in a fitting direction of said connector and said connection object.

3. The connector according to claim 1, wherein said connection portion is arranged between said first insulator and said second insulator.

4. The connector according to claim 1, wherein said adjustment portion is configured to oppose said contact on a side opposite to a fitting side of said connector and said connection object with respect to said second insulator.

5. The connector according to claim 1, wherein said contact is one of a plurality of contacts in arrangement, and said adjustment portion extends in an arranging direction of said plurality of contacts to include an area in which said plurality of contacts are arranged.

6. The connector according to claim 1, wherein said adjustment portion includes a metal member and a surface layer having an electrical insulation property.

7. The connector according to claim 1, wherein said adjustment member includes:

a latch configured to latch to said first insulator, and a connecting portion configured to couple said latch and said adjustment portion together.

8. The connector according to claim 7, wherein said connecting portion is located on a fitting side with respect to said contact in a fitting direction of said connector and said connection object.

9. The connector according to claim 1, wherein said second insulator includes a protrusion protruding toward said adjustment portion from an outer surface which opposes said adjustment portion of said adjustment member.

10. An electronic device comprising a connector according to claim 1.

* * * * *